US005626503A

United States Patent [19]

Heftel et al.

[11] Patent Number: 5,626,503

[45] Date of Patent: May 6, 1997

[54] ARTICLE FOR HOLDING ACCESSORIES

[75] Inventors: William R. Heftel; Barbara A. Heftel; Lisa R. Heftel, all of Chesterfield, Mo.

[73] Assignee: Heftel Creations, Inc., Chesterfield, Mo.

[21] Appl. No.: 442,982

[22] Filed: May 17, 1995

Related U.S. Application Data

[63] Continuation-in-part of Ser. No. 345,986, Nov. 28, 1994, abandoned.

[51] Int. Cl.[6] ..... A63H 3/00; A63H 3/02

[52] U.S. Cl. ..... 446/73; 446/268; 446/369; 132/275

[58] Field of Search ..... 446/73, 72, 76, 446/268, 368, 369, 370, 372; 63/1.1, 2, 12; 132/212, 273, 275, 276, 279

[56] References Cited

U.S. PATENT DOCUMENTS

| | | | |
|---|---|---|---|
| D. 170,007 | 7/1953 | Collins . | |
| D. 240,242 | 6/1976 | Orenstein . | |
| D. 241,044 | 8/1976 | Daenen . | |
| D. 274,924 | 7/1984 | Radosevich et al. . | |
| D. 283,719 | 5/1986 | Walsh . | |
| 636,105 | 10/1899 | Beller . | |
| 1,571,279 | 2/1926 | Lamb . | |
| 1,819,295 | 8/1931 | Holt . | |
| 1,949,465 | 3/1934 | Gammeter . | |
| 2,170,778 | 8/1939 | Huppert | 132/275 |
| 2,591,379 | 4/1952 | Schradermeier | 446/72 |
| 2,802,568 | 8/1957 | Knox . | |
| 3,759,377 | 9/1973 | Weimer . | |
| 3,930,331 | 1/1976 | Simeone | 446/369 |
| 4,505,687 | 3/1985 | Munro . | |
| 4,815,999 | 3/1989 | Ayon et al. . | |
| 4,816,001 | 3/1989 | Narvaez et al. . | |
| 4,889,512 | 12/1989 | Burnett et al. . | |
| 4,905,821 | 3/1990 | Corbett | 206/45.24 |
| 4,921,460 | 5/1990 | Lin . | |
| 4,968,279 | 11/1990 | Smith | 446/71 |
| 5,044,385 | 9/1991 | Rhodes | 132/275 X |
| 5,156,171 | 10/1992 | Goodman . | |
| 5,301,696 | 4/1994 | Revson | 132/273 |
| 5,344,356 | 9/1994 | Pizzelli et al. . | |
| 5,433,643 | 7/1995 | Pratt | 446/73 |

FOREIGN PATENT DOCUMENTS

| | | | |
|---|---|---|---|
| 2257057 | 11/1983 | France | 132/275 |
| 2639840 | 6/1990 | France . | |

*Primary Examiner*—Robert A. Hafer
*Assistant Examiner*—D. Neal Muir
*Attorney, Agent, or Firm*—Senniger, Powers, Leavitt & Roedel

[57] ABSTRACT

An article for holding annular elastic hair ties, hair clips and earrings in a decorative fashion in which the hair ties, hair clips and earrings appear to form the clothing of the article. The article has an elongate body and face. The body has a hair tie receiving portion having a cross sectional dimension larger than the internal diameter of the annular hair ties in their relaxed configurations. The article has a hair clip receiving strip for attaching the hair clips thereto. The article also has an earring holder for receiving earrings. The article has a loop attached to the body for hanging the article in an upright position with the face above the hair tie and hair clip receiving portion of the article.

10 Claims, 6 Drawing Sheets

ARTICLE FOR HOLDING ACCESSORIES

CROSS-REFERENCE TO RELATED APPLICATION

This application is a continuation-in-part of application Ser. No. 08/345,986 filed Nov. 28, 1994, abandoned.

BACKGROUND OF THE INVENTION

This invention relates generally to accessory storage devices, and more particularly to an article for holding multiple accessories such as hair ties, hair clips and earrings.

Accessories are typically stored loosely in a drawer or container, which makes the selection of a specific design or color accessory difficult. Frequently, one must remove a number of the accessories from the drawer before the desired one is located. The accessories may become lost in the drawer among other items because of the lack of organization. Moreover, there is no positive impetus, particularly for younger girls, to keep their accessories in an organized fashion at one location when the standard mode of storage is to toss them into a drawer. In addition, the storing of accessories in an unorganized fashion may result in the accessories becoming entangled with one another, and the accessory becoming damaged.

Accordingly, there is presently a need for a convenient way to store accessories in a neat, organized manner.

SUMMARY OF THE INVENTION

Among the several objects of this invention may be noted the provision of an article for holding accessories, such as annular elastic hair ties, hair clips and earrings, in a decorative fashion in which the accessories appear to form the clothing of the article; the provision of such an article which may be decorated to appear as a doll; the provision of such an article which stores accessories so as to prevent damage to the accessories; the provision of such an article which will encourage younger girls to store their accessories in an organized manner; and the provision of such an article which is economical to manufacture and easy to use.

Further among the several objects and features of the present invention may be noted the provision of the combination of the article and the accessories held thereon which produces a decorative article.

Generally, an article of this invention holds annular elastic hair ties in a decorative fashion in which the hair ties appear to form the clothing of the article. The article comprises an elongate body having a face depicted at one end of the body. The body includes a hair tie receiving portion having a cross sectional dimension sized larger than the internal diameter of the annular hair ties in their relaxed configurations whereby the elastic hair ties grip the body and are held on the body. The article also comprises a loop attached to one end of the body for hanging the article in an upright position with the face above the accessories on the hair tie receiving portion.

In another aspect of the present invention, an article for holding accessories, including annular elastic hair ties and hair clips in a decorative fashion, comprises an elongate body sized in cross section larger than the internal diameter of the hair ties in their relaxed configurations so that the hair ties received on the hair tie receiving portion of the body grip the body and are held on the body. Strip means mounted on the body attaches hair clips on the body by receiving a portion of the hair clip between the body and the strip means.

Combinations of the accessories with the various articles are also disclosed.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
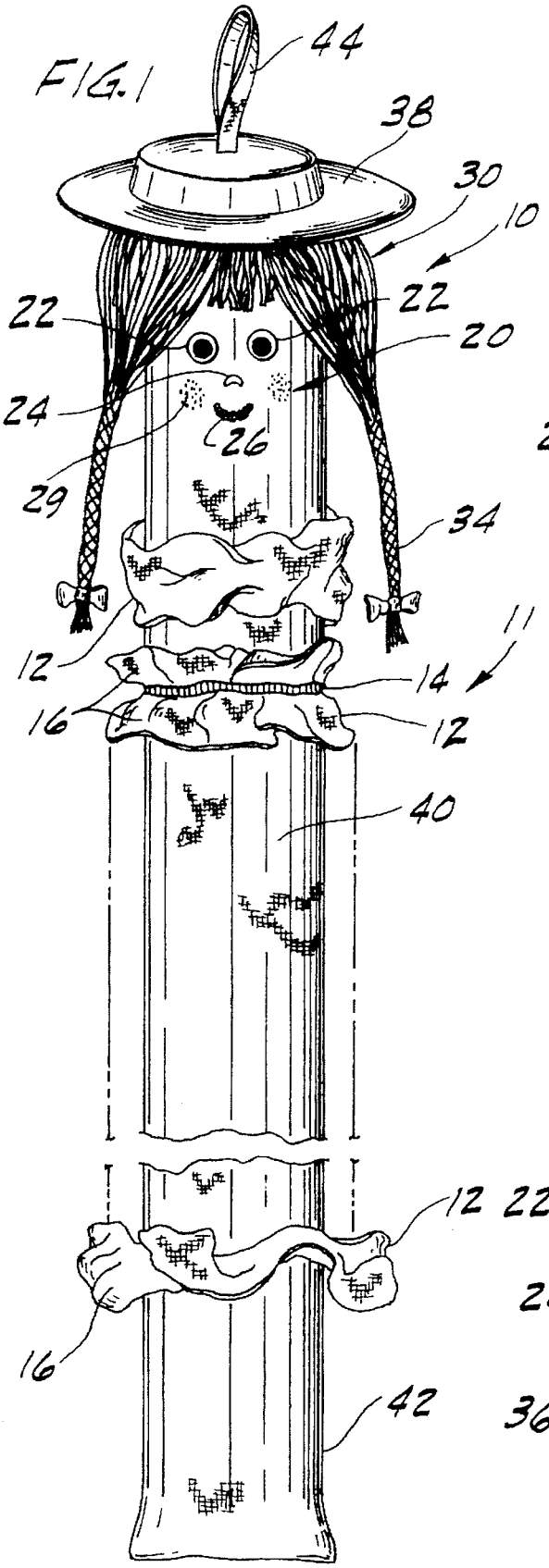
FIG. 1 is a fragmentary front elevation showing an article for holding accessories of a first embodiment of this invention having a human face and hair.

Referring now to the drawings, and first to FIG. 1, there is generally indicated at 10 a doll (broadly, "an article") of this invention for holding accessories (generally indicated at 11), such as hair ties 12. The accessories 11, as mounted on the doll 10, appear as clothing worn by the doll.

The doll 10 may hold many different types of hair ties 12 which, when removed from the doll are capable of encircling long human hair for holding the hair in a selected position on the head. The hair ties 12 may comprise an annular elastic band 14 (FIG. 1) and material 16 mounted on the elastic band and being gathered on the band so that the material has a ruffled appearance. These types of hair ties 12 are sometimes referred to as "scrunchies" or "twisters" and are formed with an elastic band 14 either sewn on one side of the material 16, or enclosed within a tubular piece of material. The material 16 is gathered on the band to provide a ruffled appearance. Pieces of ribbon (not shown) used to tie up loose hair may also be tied around a hair tie receiving portion 40 of the doll. These pieces of ribbon are not annular until tied in the hair or on the doll 10 and lack the elastic band 14. The hair ties 12 may be of any design or color and made of various materials.

Figure 2:
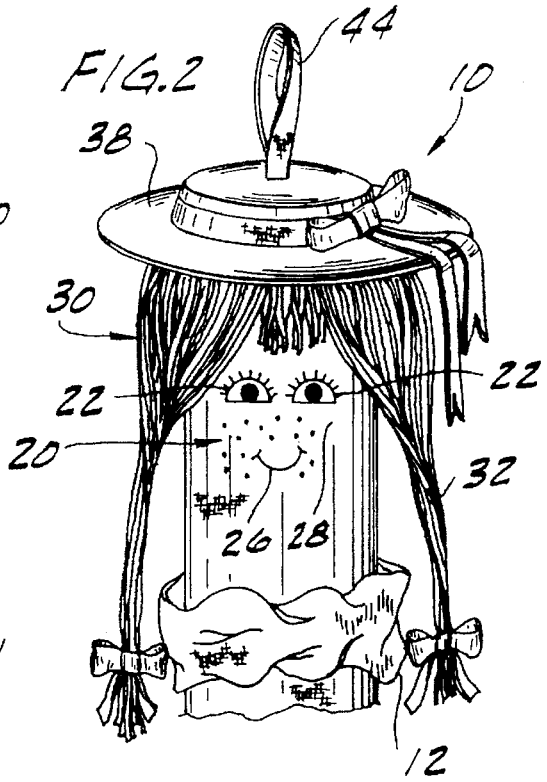
FIG. 2 is a fragmentary front elevation of an article having a different face and hair.
Figure 3:
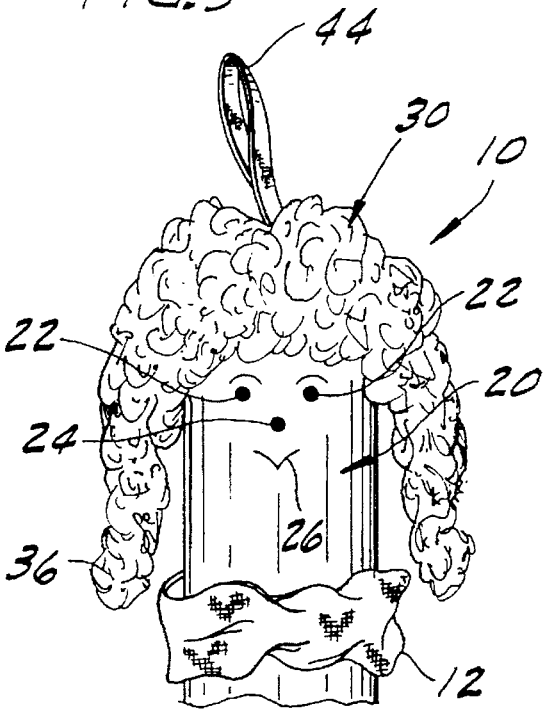
FIG. 3 is a fragmentary front elevation of an article having a different face and hair.

More specifically, the doll 10 comprises an elongate body 42 having a human face 20 depicted at one end of the body. The doll body 42 comprises an outer generally tubular fabric sleeve and soft stuffing 51 disposed within the sleeve, giving the sleeve a generally cylindrical shape. In the illustrated embodiment, the body 42 is made of two rectangular pieces of fabric sewn together along their peripheral edges to enclose the soft stuffing material 51. It is envisioned that the doll 10 may have different types of faces 20 and styles of hair 30, such as shown in FIGS. 2 and 3. The face may be comprised of any combination of the features shown in FIGS. 1–3 and 5 (e.g., eyes 22, nose 24, mouth 26, freckles 28, blush 29). These features may be material or button type pieces (e.g., eyes 22 of FIG. 1) and sewn onto the doll. The features may also be drawn on the doll with permanent marker or paint or embroidered into the fabric of the body 42. The doll 10 has hair 30 at the end of the body where the face 20 is located which in the preferred embodiment is formed from yarn or other similar material. The hair may be arranged in any of the configurations shown in FIGS. 1–3 (i.e., pig tails 32, braids 34 or curls 36), and attached as by stitching (not shown) to the body. Alternatively, the hair 30 may be painted, printed or embroidered onto the end of the body. The doll may also have a hat 38 disposed on top of the hair 30. Other decorative designs for the doll face, hair and hat may also be used and still fall within the scope of the present invention.

The body 42 includes a hair tie receiving portion 40 having a cross sectional dimension sized larger than the internal diameter of the annular hair ties 12 in their relaxed configurations whereby the elastic hair ties grip the body and retain themselves on the body. For example, the width of the receiving portion of the doll would be approximately 3 inches, to hold hair ties which are 2.5 inches or smaller in diameter. The length of the body is approximately 19.5 inches. It is to be understood that the dimension of the doll 10 may be other than stated herein and still fall within the scope of the invention. The hair tie receiving portion 40 is arranged in relation to the face 20 of the doll 10 whereby hair ties 12 held thereon appear as clothing being worn by the doll. Each hair tie 12 encircles the hair tie receiving portion 40 of the body 42 and is disposed in side-by-side relation with the other hair ties on the hair tie receiving portion of the body.

The doll 10 has a loop 44 attached to the one end of the body for hanging the doll in an upright position with the face 20 above the hair ties 12 on the hair tie receiving portion 40 of the doll. The loop 42 is preferably sized to fit over a door knob, or to receive a hook for hanging the doll 10 and hair ties 12 on the wall or in another convenient location. For example, the length of the loop 42 as measured from the connection to the body to the end of the loop is approximately 7.5 inches. It is to be understood that the length of the loop 42 may be other than stated herein and still fall within the scope of the invention. One hair tie 12 located in the middle of the body 42 between other hair ties is easily removed from the body and replaced in the same or different location on the body. To remove the selected hair tie 12, the elastic band 14 is expanded, as by pulling on opposite sides of the hair tie, so that its internal diameter is larger than the outer diameter of the hair ties below the selected hair ties on the body. The selected hair tie 12 is then moved down over the other hair ties without disturbing them, and off of the body 42 to be worn. Replacement of the hair ties is accomplished by reversing the process described for removal.

Figure 5:
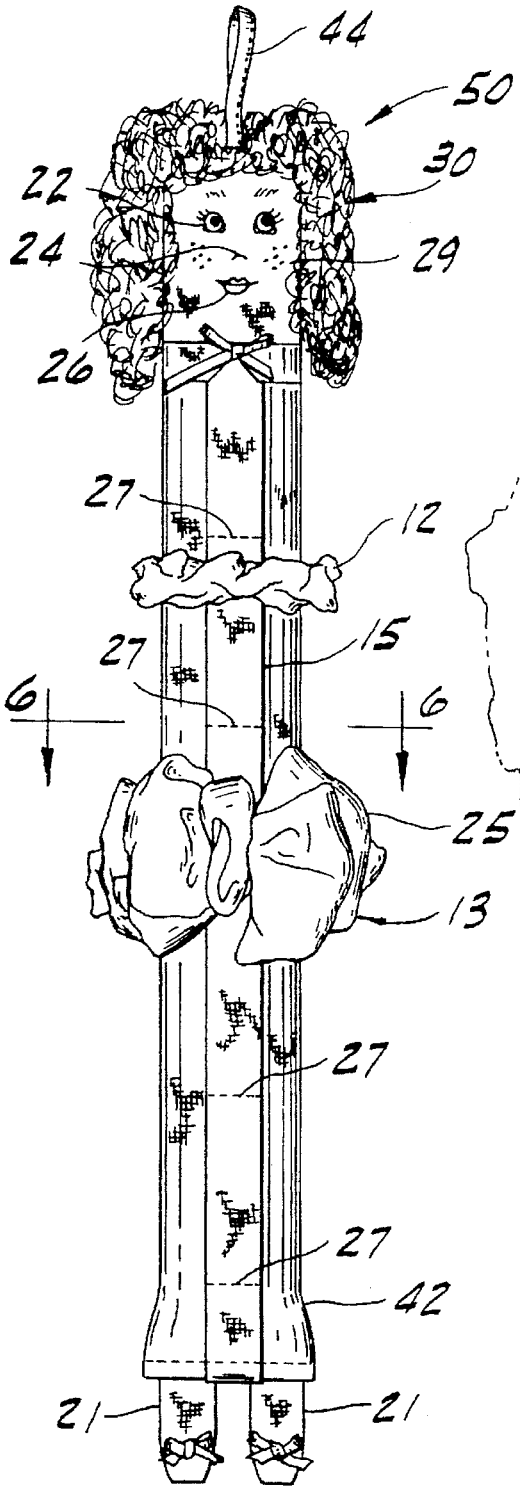
FIG. 5 is a fragmentary front elevation showing a second embodiment of the article holding hair ties and hair clips.
Figure 6:
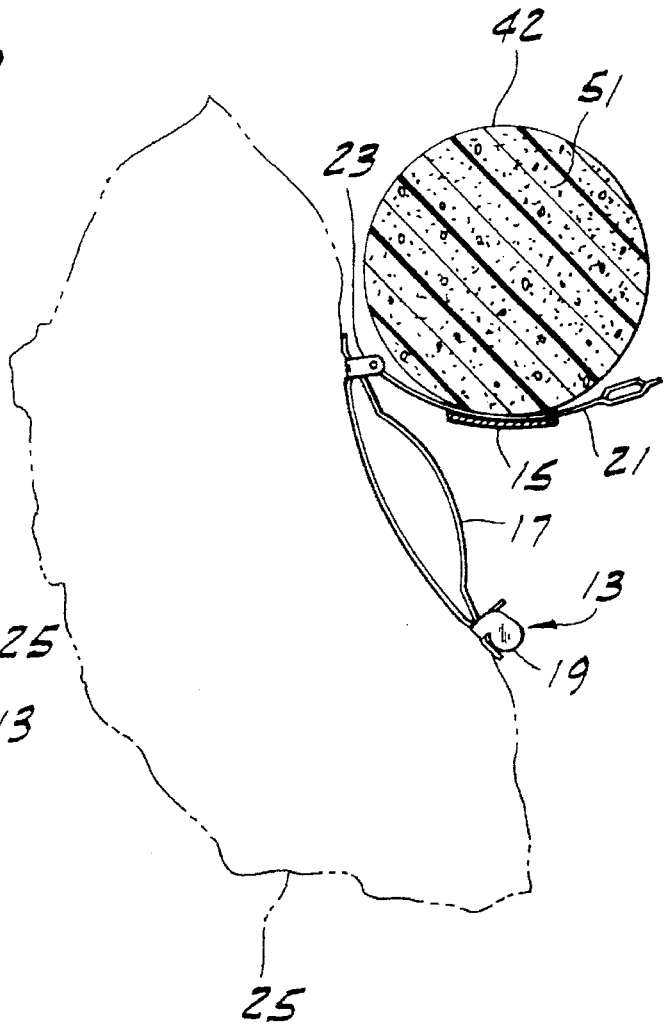
FIG. 6 is a cross section taken in the plane of line 6—6 of FIG. 5.

Referring now to FIG. 5, there is generally indicated at 50 a doll of a second embodiment of the present invention for holding hair clips 13, as well as hair ties 12. The hair clips 13 are of the type which are capable of securing human hair (not shown) between a locking piece 17 and clasp 21 to maintain a selected style on the head. The hair clips 13 may be of conventional construction, having a locking piece 17 including two outer flanges 19 (only one is shown), and a clasp 21 joined together by a hinge 23 upon which the clasp is pivotable. The locking piece 17 and clasp 21 may be made of metal, plastic or other suitable material. The hair clip 13 is opened by squeezing the two outer flanges 19 towards the clasp located between the two flanges to release the clasp 21. The hair clip is closed by snapping the clasp 21 in between the two outer flanges 19. The hair clip 13 may be decorated by pieces of material in the form of a bow 25 which may be glued or sewn onto the locking piece 17. Other types of hair clips may also be used, e.g., having different locking mechanisms and ornamentation, and still fall within the scope of the present invention.

The doll 50 further comprises a strip 15 mounted on the body 42 for attaching the hair clips 13 to the body. The clasp 21 of each hair clip is received between the body 42 and the strip 15 and engaged with the locking piece 17 so that the hair clip 13 is held on the doll by the strip. The strip 15 comprises an elongate piece of ribbon having a width less than the width of the elongate body 42, and extending lengthwise of the elongate body. The strip 15 is joined to the body 42 at spaced apart locations by lines 27 of stitching extending perpendicular to the length of the body. It is envisioned that a strip (not shown) may be in separate segments attached to the body 42 at spaced apart locations.

As shown in FIG. 5 the doll may also have feet 21 attached at a second end of the body. Other decorative designs for legs, feet or shoes may also be used and still fall within the scope of the present invention.

One hair clip 13 located in the middle of the body 42 between other accessories is easily removed from the body and replaced in the same or different location on the body. To remove the hair clip 13, it is snapped open by pressing the two outer flanges 19 of the locking piece 17 towards each other to release the clasp 21. The clasp 21 is then slid laterally from between the strip 15 and body 42. A hair tie 12 located above a hair clip 13 may also be easily removed from the body and replaced. To remove the selected hair tie 12, the elastic band 14 is expanded, as by pulling on opposite sides of the hair tie, so that its internal diameter is larger than the outer diameter of the hair ties and greatest width of the hair clips below the selected hair tie on the body. The selected hair tie 12 is then moved down over the other hair ties and hair clips without disturbing them, and off of the body 42 to be worn. Replacement of the hair tie is accomplished by reversing the process described for removal.

Figure 7:
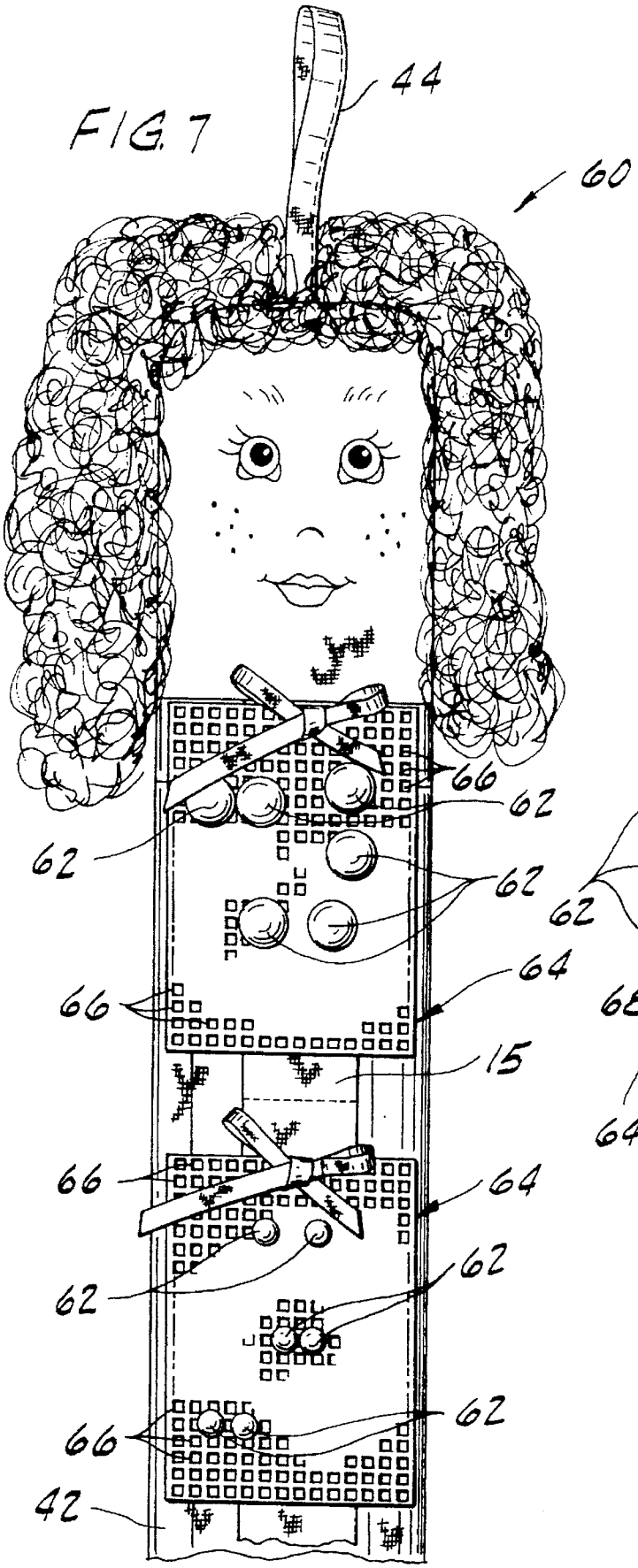
FIG. 7 is a fragmentary front elevation of a third embodiment of the article holding hair ties, hair clips and earrings.
Figure 8:
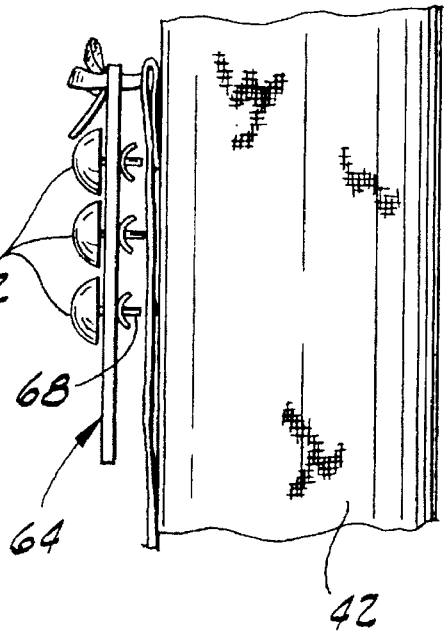
FIG. 8 is a side view of the doll of FIG. 7 showing earrings secured on an earring holder.

Referring now to FIG. 7, there is generally indicated at 60 a doll of a third embodiment of the present invention for holding earrings 62, as well as hair ties 12 around the body 42 and hair clips 13 on the strip 15. An earring holder, generally indicated at 64, is located adjacent to the face of the doll. The earring holder 64 comprises a sheet of mesh-like material having openings 66 therein sized to receive a post 68 of an earring 62 therethrough for securing the earring to the sheet of material. The earring holder 64 may be of various sizes or shapes as long as it is sufficiently thin to allow the post 68 to pass through. The earring holder 64 may be attached to the strip 15 or directly to the doll itself in a suitable manner such as by sewing. One end of the earring holder 64 preferably hangs freely from the doll to allow access to the back of the earring holder for easy removal and attachment of earrings 62.

Figure 9:
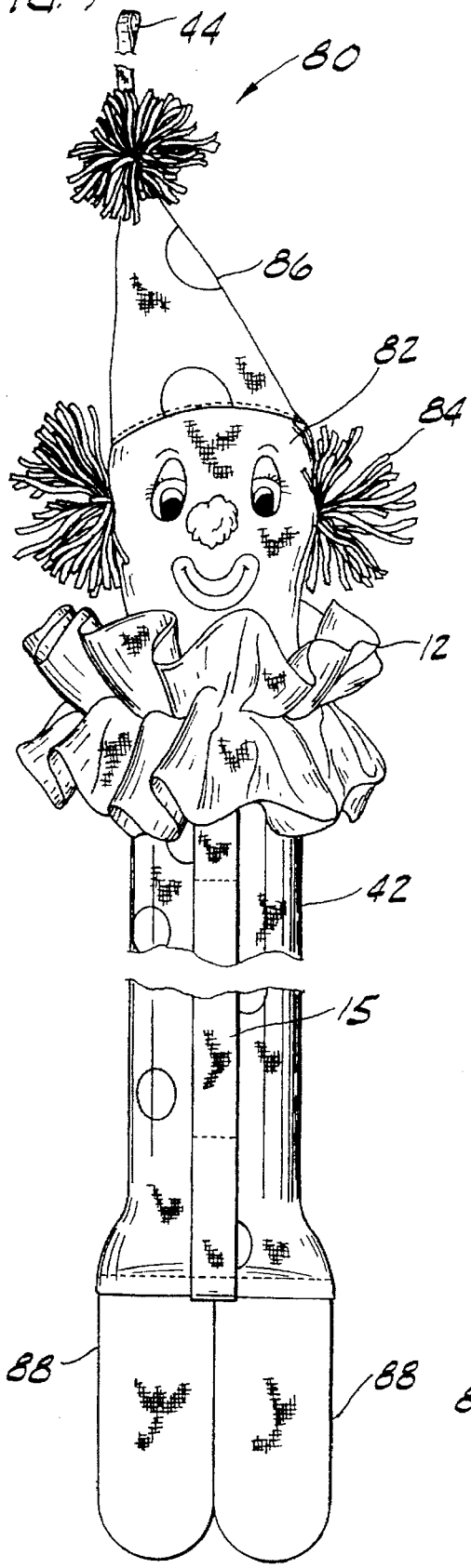
FIG. 9 is a fragmentary front elevation showing an article of the second embodiment of this invention having a clown face and hair.
Figure 10:
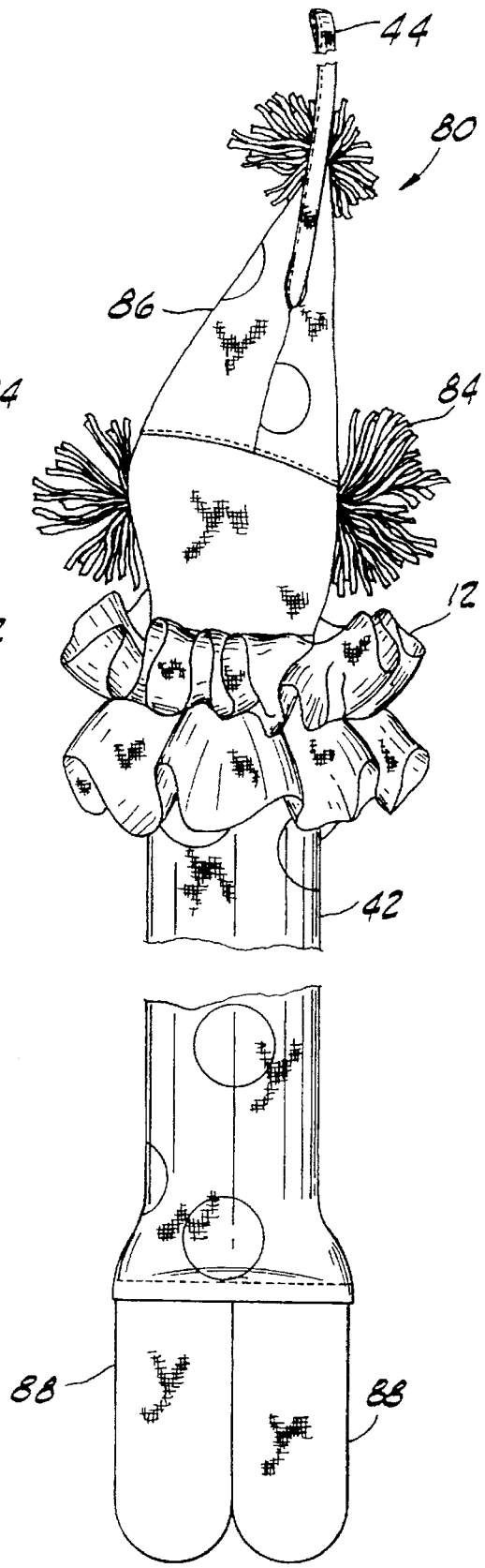
FIG. 10 is a fragmentary rear elevation of the clown of FIG. 9.

Referring now to FIGS. 9 and 10, there is generally indicated at 80 a doll of the second embodiment in the form of a clown. The clown 80 comprises an elongate body 42 having a face 82 depicted at one end of the body. The clown 80 includes hair 84 located at the end of the body where the face 82 is located which in the preferred embodiment is formed from yarn or other similar material. The clown 80 may also have a hat 86 disposed on top of the hair 84. As shown in FIG. 9, the clown 80 may further comprise feet 88 extending from an end opposite the end where the face 82 is located. A strip 15 extends down the front of the clown for receiving and holding hair clips 13, as described above. Other decorative designs may also be used for the clown face 82, hair 84, hat 86 and feet 88 and still fall within the scope of the present invention.

Figure 11:
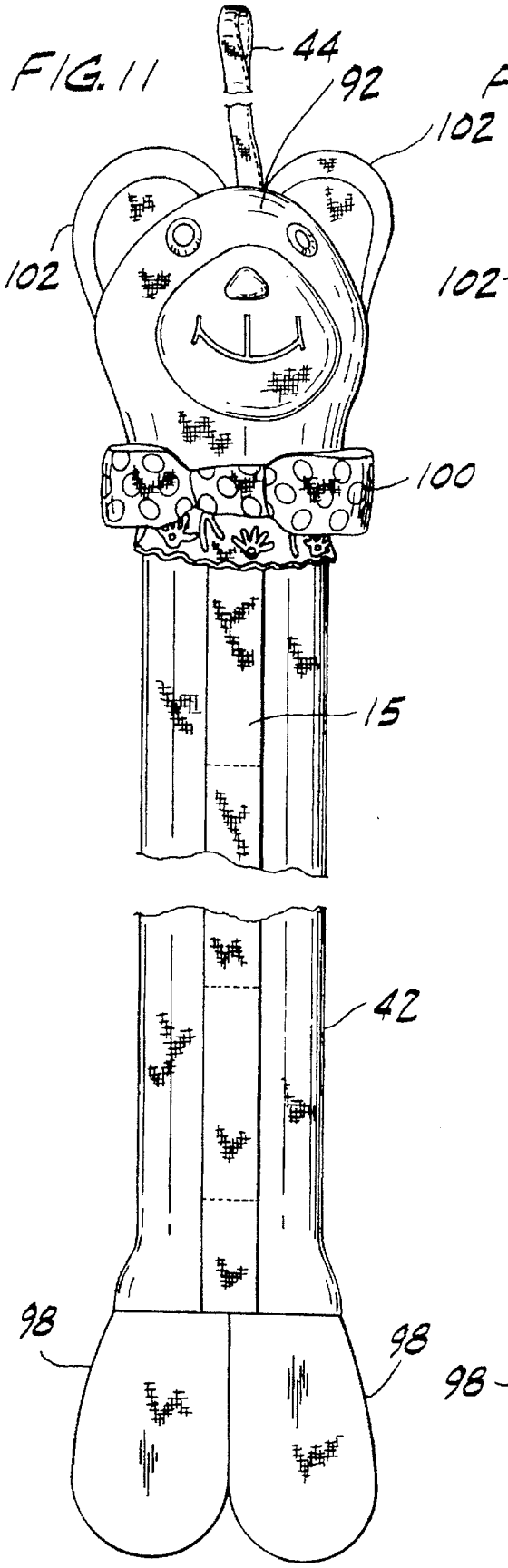
FIG. 11 is a fragmentary front elevation showing an article of the second embodiment of this invention having a bear's face.
Figure 12:
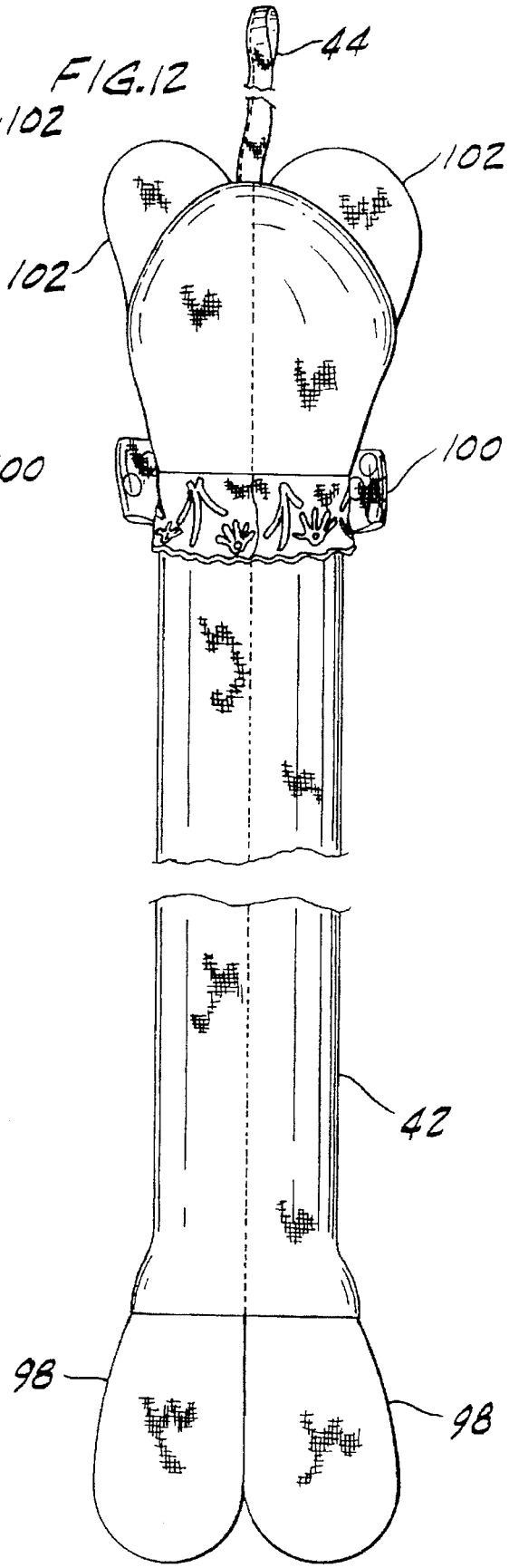
FIG. 12 is a fragmentary rear elevation of the bear of FIG. 11.

As shown in FIGS. 11 and 12, a doll of the second embodiment in the form of a bear, generally indicated at 90, comprises an elongate body 42 having a face 92 depicted at one end and feet 98 extending from the other end. A strip 15 extends down the front of the bear for receiving and holding hair clips 13, as described above. As shown in FIG. 11, the bear may include a decorative bow tie 100 located adjacent the face 92 and ears 102 located at the same end of the body as the face. The bear 90 may be made of terry cloth or other suitable material to give it a furry appearance. Other animal faces may also be used and still fall within the present invention.

It is to be understood that the articles shown in FIGS. 9–12 can include an earring holder 64 (not shown) to hold earrings.

Figure 4:
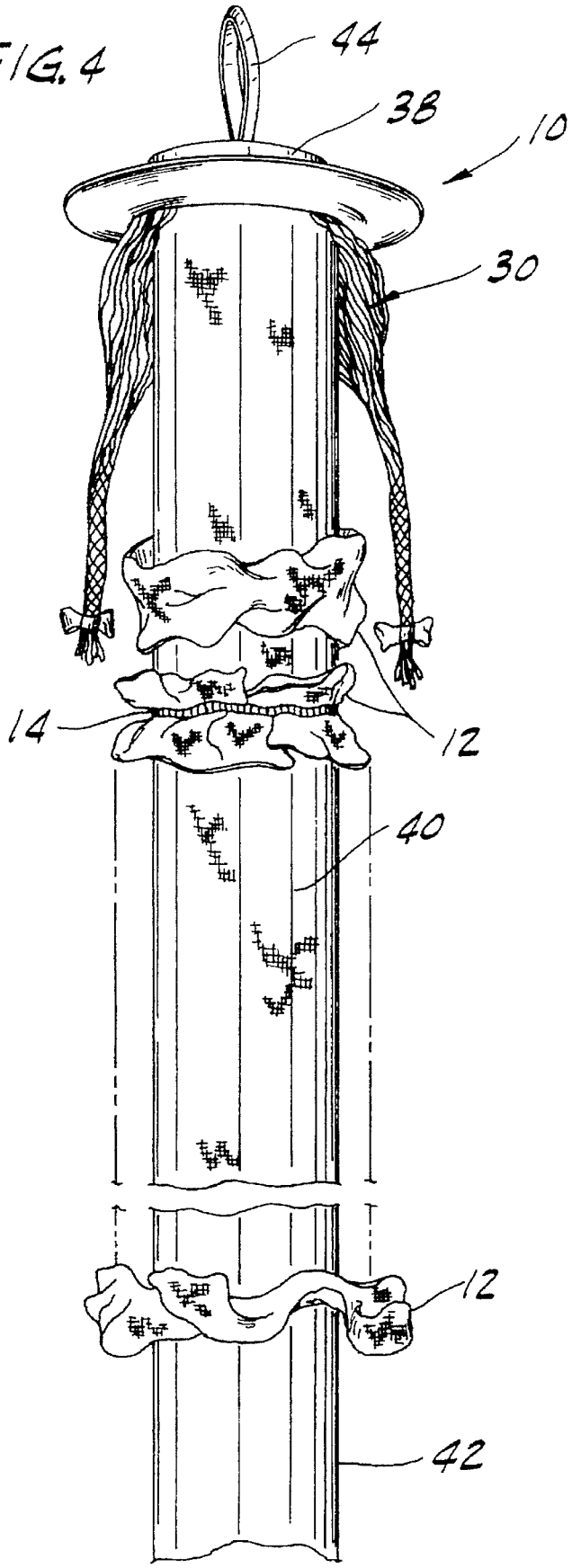
FIG. 4 is a fragmentary rear elevation of the article of FIG. 1.

In view of the above, it will be seen that the several objects of the invention are achieved and other advantageous results attained. The elongate body 42 holds the accessories 11 so that each accessory can be readily observed and removed from the body for wearing. Replacement of the selected accessory 11 on the body is also simple. The body 42 holds the accessories 11 so that they do not become entangled with one another, and also holds the shape of the accessories so that they do not become wrinkled or creased. When multiple accessories 11 are held on the body below the face 20 (as shown in FIGS. 1 and 4) the doll 10 is very decorative, because the accessories appear to form clothing (e.g., a fancy, ruffled dress) worn by the dolls 10, 50. The decorative appearance of the articles 10, 50, 60, 80 and 90 when serving their function of holding accessories 11 is believed to encourage younger girls to replace their accessories on the doll. Thus, the accessories 11 are less likely to become lost and do not clutter up the girl's room or dresser drawer. The loop 44 permits the articles 10, 50, 60, 80 and 90 to be hung up in a convenient location (e.g., next to a mirror on the wall) for display and so a accessory can be quickly selected from the article and put on.

As various changes could be made in the above construction without departing from the scope of the invention, it is intended that all matter contained in the above description and shown in the accompanying drawings shall be interpreted as illustrative and not in a limiting sense.

What is claimed is:

1. In combination, a plurality of annular elastic hair ties and an article holding the hair ties, each hair tie comprising a length of material sized and shaped such that, when removed from the article, the hair tie may encircle long human hair for holding the hair in a selected position on the head, the article comprising an elongate cylindrical body having a face depicted at one end, the body including a hair tie receiving portion extending generally from an end of the body opposite the face to a location adjacent to the face receiving a multiplicity of the hair ties along the entire length of the body, the hair tie receiving portion having a length and a cross sectional dimension larger than an internal diameter of the hair ties whereby the hair ties received on the hair tie receiving portion grip the body and are self-retaining on the body, the cross sectional dimension of the hair tie receiving portion being substantially constant along the length of the hair tie receiving portion and free of obstructions which would inhibit placement of the hair tie at any place along the length of the hair tie receiving portion from that end of the hair tie receiving portion removed from the face to the end of the hair tie receiving portion adjacent the face to facilitate movement of the hair ties along the full length of the hair tie receiving portion with minimal stretching to increase the internal diameter of the hair ties to an amount greater than the cross sectional dimension of the hair tie receiving portion, each hair tie encircling the hair tie receiving portion of the body and being disposed in generally side-by-side relation with the other hair ties on the hair tie receiving portion of the body, the hair tie receiving portion and hair ties disposed thereon being arranged in relation to the face of the article whereby hair ties received thereon appear as a dress being worn by the article.

2. The combination as set forth in claim 1 wherein the article further comprises a loop attached to said one end of the body for hanging the article in an upright position with the face above the hair ties on the hair tie receiving portion of the article.

3. In combination, a plurality of hair ties and an article for holding the hair ties, each hair tie comprising a length of material sized and shaped such that, when removed from the article, the hair tie may encircle long human hair for hold the hair in a selected position on the head, the article comprising an elongate body having a face depicted at one end, the body including a hair tie receiving portion spaced from said one end of the body, each hair tie encircling the hair tie receiving portion of the body and being disposed in generally side-by-side relation with the other hair ties on the hair tie receiving portion of the body, the hair tie receiving portion and hair ties disposed thereon being arranged in relation to the face of the article whereby hair ties received thereon appear as a dress being worn by the article, at least one hair clip comprising a clasp pivotally mounted on a locking piece for holding hair between the clasp and locking piece, and strip means mounted on the body attaching the hair clip to the body, the clasp of the hair clip being received between the body and said strip means and engaged with the locking piece so that the hair clip is held on the article by said strip means, said strip means and hair clip held thereon being arranged in relation to the face of the article whereby the hair clip, in combination with the hair ties appear as clothing being worn by the article.

4. The combination as set forth in claim 3 wherein said strip means comprises an elongate strip of material having a width less than the width of the elongate body.

5. The combination as set forth in claim 4 wherein the strip of material comprises a ribbon extending generally lengthwise of the elongate body and being joined to the elongate body at spaced apart locations.

6. The combination as set forth in claim 3 further comprising a loop attached to one end of the body for hanging the article in an upright position with the hair tie receiving portion, said strip means being located below the depicted face.

7. The combination as set forth in claim 6 wherein said strip means comprises a ribbon extending generally lengthwise of the body and constructed for receiving a portion of the hair clip between the body and the strip means, the ribbon being joined to the body at spaced apart locations thereby to permit insertion of the hair clip portion between the ribbon and the body intermediate said spaced apart locations.

8. The combination as set forth in claim 6 further comprising an earring holder attached to the body for holding earrings thereon.

9. The combination as set forth in claim 8 wherein the earring holder comprises a sheet of material having openings therein sized to receive a portion of an earring therethrough for securing the earring to the sheet of material.

10. The combination as set forth in claim 9 wherein the earring holder is secured to the body at a location adjacent to the face depicted on the body.

* * * * *